US007141014B2

(12) United States Patent
Saltykov

(10) Patent No.: US 7,141,014 B2
(45) Date of Patent: Nov. 28, 2006

(54) CUSHIONING DEVICE FOR USE WITH A HEARING AID

(75) Inventor: Oleg Saltykov, Fairlawn, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 516 days.

(21) Appl. No.: 10/158,746

(22) Filed: May 30, 2002

(65) Prior Publication Data

US 2003/0181783 A1 Sep. 25, 2003

Related U.S. Application Data

(60) Provisional application No. 60/365,944, filed on Mar. 20, 2002.

(51) Int. Cl.
*H04R 25/00* (2006.01)

(52) U.S. Cl. ..... 600/25; 381/328

(58) Field of Classification Search ..... 600/25; 381/325, 328, 322, 60, 324, 326, 327, 380; 181/135, 128, 129, 130
See application file for complete search history.

(56) References Cited

U.S. PATENT DOCUMENTS 4,420,657 A 12/1983 Larkin
4,729,451 A 3/1988 Brander et al.
4,880,076 A 11/1989 Ahlberg et al.
5,002,151 A 3/1991 Oliveira et al.
5,321,757 A * 6/1994 Woodfill, Jr. ..... 381/312
5,420,381 A 5/1995 Gardner, Jr. et al.
5,654,530 A * 8/1997 Sauer et al. ..... 181/130
5,682,020 A 10/1997 Oliveira
5,748,743 A 5/1998 Weeks
5,792,998 A 8/1998 Gardner, Jr. et al.
5,853,005 A 12/1998 Scanlon
5,917,918 A 6/1999 Callahan
6,022,311 A 2/2000 Juneau et al.
6,096,146 A 8/2000 Poloni et al.
6,228,020 B1 5/2001 Juneau et al.
6,254,526 B1 7/2001 Juneau et al.
6,513,621 B1 * 2/2003 Deslauriers et al. ..... 181/130
2002/0196958 A1 * 12/2002 Halteren et al. ..... 381/328

* cited by examiner

*Primary Examiner*—Samuel G. Gilbert
(74) *Attorney, Agent, or Firm*—Alexander J. Burke; Joel Miller

(57) ABSTRACT

A cushioning device for use with a hearing aid instrument for positioning in the ear of a user is disclosed. The cushioning device comprises a ring volume that encircles a predetermined portion of a hearing aid housing and separates the hearing aid housing from an ear canal of a user. A pliant substances is disposed within the ring volume and a reservoir which is in fluid communication with the ring volume in a manner permitting bi-directional flow of the pliant substance between the reservoir and the ring volume.

26 Claims, 3 Drawing Sheets

CUSHIONING DEVICE FOR USE WITH A HEARING AID

This is a non-provisional application of provisional application Ser. No. 60/365,944 by O. Saltykov filed Mar. 20, 2002.

FIELD OF THE INVENTION

The present invention relates to the field of hearing aids.

BACKGROUND OF THE INVENTION

Hearings aids may be inserted either partially or completely into a user's ear canal. Hearing aid housings typically comprise a rigid material. However, hearing aid housings may also be constructed using a semi-rigid material.

Gaps between the material and the ear canal can decrease the effectiveness of the hearing aid. Further, some users of completely-in-the-canal (CIC) type hearing aids have reported their use as uncomfortable. Moreover, it is common for CICs to have to be returned to the lab for modifications or housing remakes for comfort. One reason for the remakes is that ear canals move, adding an additional complication to an already complicated fitting. Further, acoustic sealing within and sensitivity of the deeper bony portion of the ear canal make fitting CIC hearing aids challenging.

For non-customized fit hearing aids, a "standard" hearing aid housing can have problems providing an adequate seal inside an ear canal, given variances in bony structures, cartilage, and other occlusions.

Portions of the hearing aid may be rigid and other portions, e.g. the tip end, may be of a softer material. However, these softer tip ends may not fit or conform to a wide variety of ear canal shapes, necessitating a plurality of such softer tip ends, e.g. replaceable tip ends.

SUMMARY OF THE INVENTION

A cushioning device may be used with a hearing aid instrument for positioning in the ear of a user. The cushioning device comprises a ring volume that encircles a predetermined portion of a hearing aid housing and separates the hearing aid housing from a portion of a user's ear canal. A pliant substance is disposed within the ring volume and a reservoir, which is in fluid communication with the ring volume, in a manner permitting bidirectional flow of the pliant substance between the reservoir and the ring volume.

In a first exemplary embodiment, the reservoir is disposed mainly on the outside of the housing. In a second exemplary embodiment, the reservoir is disposed at least partially within the housing, contacting against a movable door which in a closed position increases pressure of the pliant fluid within the reservoir and which in an open position allows for decreased pressure of the pliant fluid within the reservoir.

BRIEF DESCRIPTION OF THE DRAWINGS

The features, aspects, and advantages of the present invention will become more fully apparent from the following description, appended claims, and accompanying drawings in which:

DETAILED DESCRIPTION OF THE PREFERRED EMBODIMENT

Figure 1:
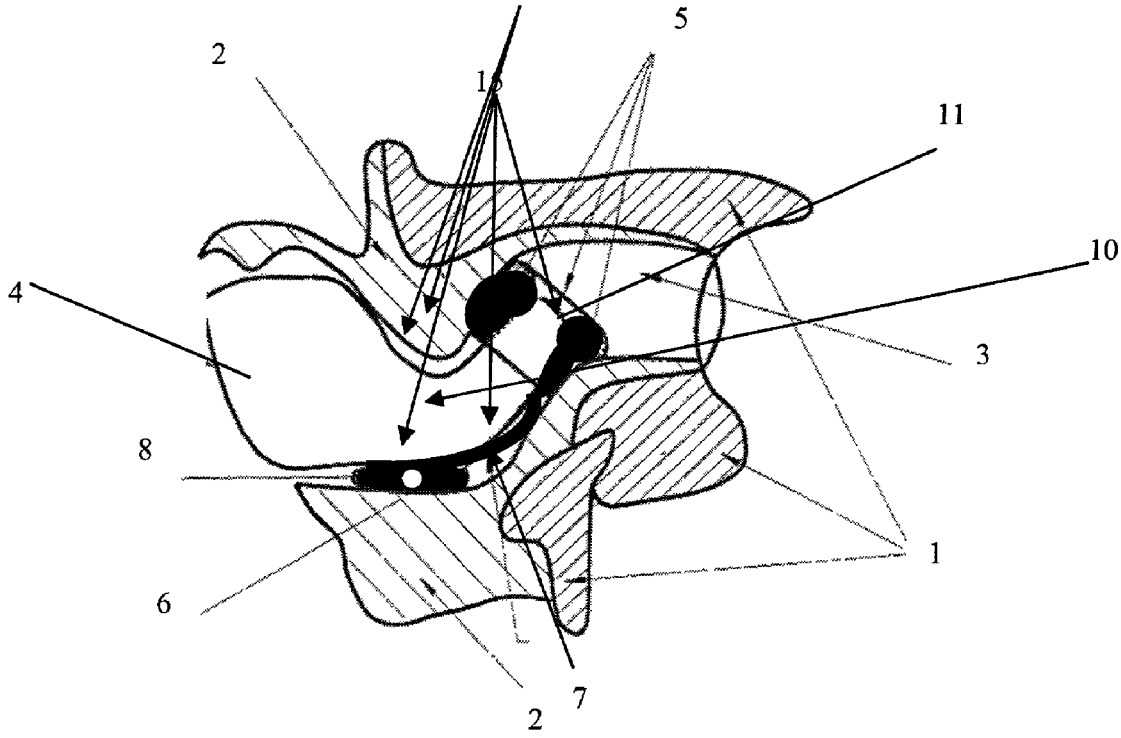
FIG. 1 is a partial cutaway, perspective plan view showing a first exemplary embodiment of a hearing aid cushioning device with a reservoir substantially disposed outside the hearing aid housing.

Referring now to FIG. 1, hearing aid, generally referred as the number "10," comprises electronics contained within a housing 4. In a preferred embodiment, housing 4 is configured to generally conform to the shape of ear canal 3, either for a specific user or for a generic shape. As shown in these exemplary embodiments, hearing aid 10 is generally of the type known as a completely in canal ("CIC") hearing aid 10, although the present invention is not limited to a CIC configuration.

Housing 4 is designed to be placed at least partially within ear canal 3 proximate bony sections 1 and cartilaginous sections 2 of the ear.

Cushioning device 15 comprises ring volume 5 which, in a preferred embodiment, is a generally torus-shaped ring volume, reservoir 6, and tube 7.

Ring volume 5 comprises a flexible material and encompasses a pliant substance. In a preferred embodiment, ring volume 5 comprises a flexible material to permit distortion of ring volume 5 in response to external pressure such as that exerted on ring volume 5 by ear canal 3. Ring volume 5 is disposed proximate to distal tip 11 of housing 4 which is positioned proximate the user's inner ear. Ring volume 5 may be secured such as by glue to a predetermined outer section of housing 4 or otherwise attached to a predetermined outer section of housing 4, e.g. fitted into a recessed channel sized to receive ring volume 5.

Reservoir 6 may comprise a pliant material and is attached to ring volume 5 in a manner that supports bidirectional flow of the pliant material between ring volume 5 and reservoir 6, e.g. by tube 7. Tube 7 may be of any appropriate material, e.g. the same pliant material as either ring volume 5 or reservoir 6. Reservoir 6 and tube 7 may be secured to a predetermined outer section of housing 4, e.g. by glue. In an alternative embodiment, reservoir 6 and tube 7 may be the same unit, i.e. reservoir 6 in fluid communication substantially directly with ring volume 5.

In typical configurations, reservoir 6, tube 7, and ring volume 5 create a substantially self-contained, sealed container for the pliant material. The pliant material flows bi-directionally between ring volume 5 and reservoir 6 and comprises a fluid, a liquid, a gel such as a silicone gel, or a malleable substance, or the like, or a combination thereof. Compressible gas volume 8 may be present within the pliant material and comprises material other than the pliant material, e.g. an air bubble, inert gas bubble, fluid other than the pliant material, and the like, or a combination thereof.

Figure 2:
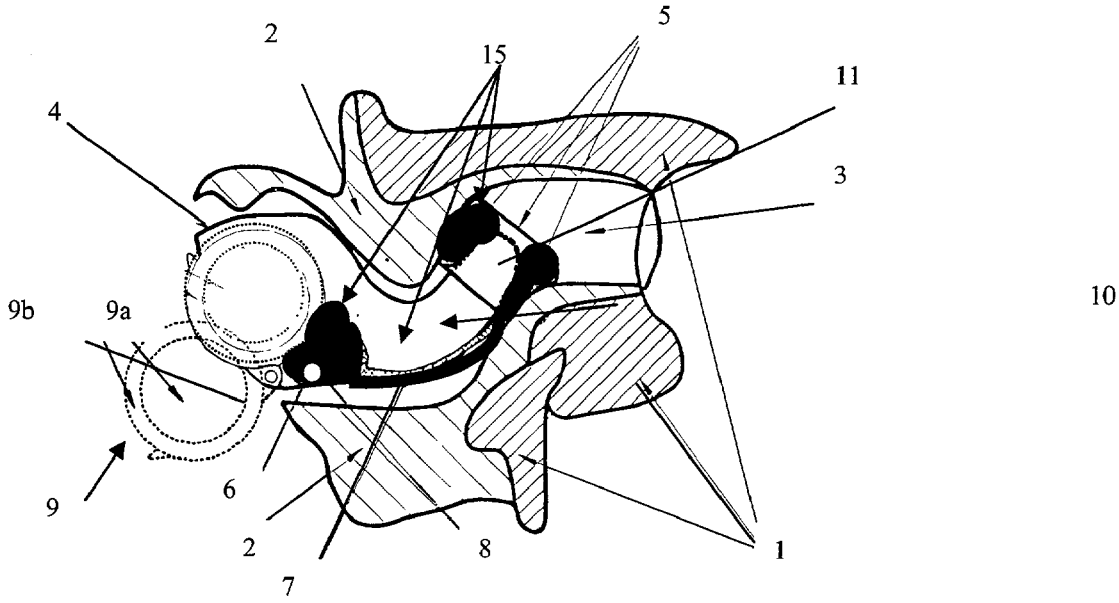
FIG. 2 is a partial cutaway, perspective plan view showing a second exemplary embodiment of a hearing aid cushioning device with a reservoir disposed at least partially inside the hearing aid housing.

Referring now to FIG. 2, in an alternative embodiment cushioning device 15 comprises ring volume 5 which, in a preferred embodiment, is a generally torus-shaped ring volume, reservoir 6, and tube 7. As with the embodiment in FIG. 1, ring volume 5 comprises a flexible material and encompasses a pliant substance. In a preferred embodiment, ring volume 5 comprises a flexible material to permit distortion of ring volume 5 in response to external pressure such as that exerted on ring volume 5 by ear canal 3. Ring volume 5 is disposed proximate to distal tip 11 of housing 4 which is positioned proximate the user's inner ear. Ring volume 5 may be secured such as by glue to a predetermined outer section of housing 4 or otherwise attached to a predetermined outer section of housing 4, e.g. fitted into a recessed channel sized to receive ring volume 5.

Reservoir 6 may comprise a pliant material and is at least partially disposed within housing 4 in a manner that supports bi-directional flow of the pliant material between ring volume 5 and reservoir 6, e.g. by tube 7. Tube 7 may be of any appropriate material, e.g. the same pliant material as either ring volume 5 or reservoir 6.

In typical configurations, reservoir 6, tube 7, and ring volume 5 create a substantially self-contained, sealed container for the pliant material. The pliant material flows bi-directionally between ring volume 5 and reservoir 6 and comprises a fluid, a liquid, a gel such as a silicone gel, or a malleable substance, or the like, or a combination thereof. As with other embodiments, compressible gas volume 8 may be present within the pliant material and comprises material other than the pliant material, e.g. an air bubble, inert gas bubble, fluid other than the pliant material, and the like, or a combination thereof.

Door 9 comprises movable battery holder 9*b* which can hold battery 9*a*. When in a closed position, a portion of door 9 contacts reservoir 6, e.g. either battery 9*a*, battery holder 9*b*, or a combination thereof. This causes pressure to be exerted on the pliant material in reservoir 6. When in an open position, door 9 is removed at least partially from contacting reservoir 6, causing pressure to be relieved on the pliant material in reservoir 6.

In the operation of an exemplary embodiment, cushion 15 provides a comfortable seal between housing 4 of hearing aid 10 and ear canal 3, especially in non-custom hearing aids 10 where a one size housing 4 is typically used.

Referring back to FIG. 1, in typical configurations, housing 4 is either custom made to fit a specific ear canal 3 or is made to be smaller in its dimension than an average ear canal 3. Ring volume 5 is filled with pliant material and then fitted or otherwise attached, such as by gluing, to a predetermined portion of distal tip 11 of housing 4. Ring volume 5 is connected with reservoir 6, such as by tube 7, and reservoir 6 is also filled with the pliant material. In a preferred embodiment, compressible gas volume 8 is left in reservoir 6.

Figure 3:
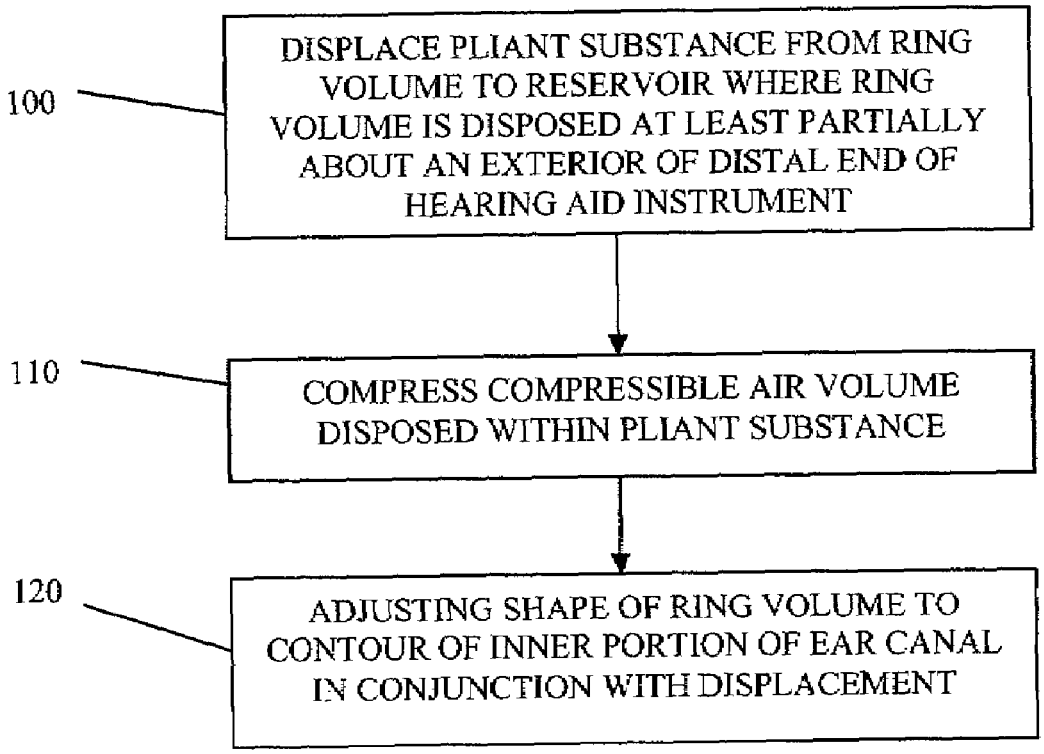

When hearing aid 10 is being inserted into ear canal 3, as distal tip 11 goes deeper into ear canal 3, excessive pliant material is displaced (step 100 in FIG. 3) from ring volume 5 into the reservoir 6, e.g. through tube 7. As the insertion progresses, reservoir 6 begins to contact ear canal 3, compressing the pliant material inside reservoir 6 and moving the pliant material into ring volume 5, back through tube 7. Ring volume 5 inflates with the pliant material, sealing an area between distal tip 11 and ear canal 3 (step 120 in FIG. 3).

Compressible gas volume 8 is compressed as hearing aid 10 is inserted into ear canal 3 (step 110 in FIG. 3) and helps to avoid excessive pressure within cushion 15. Compressible gas volume 8 acts as a spring, helping to prevent the creation of excessive pressure where ring volume 5 contacts ear canal 3.

In an alternate embodiment, referring back to FIG. 2, hearing aid 10 has a different configuration. Reservoir 6 is located at least partially inside housing 4, proximate door 9. When door 9 is open, reservoir 6 is not impacted and ring volume 5 is not inflated (step 100 in FIG. 3). In this configuration, hearing aid 10 can be inserted into ear canal 3. After hearing aid 10 is inserted into ear canal 3, the user closes door 9, allowing a predetermined portion of door 9, e.g. battery 9*a* and/or battery holder 9*b*, to provide pressure to reservoir 6, causing the pliant material to flow from reservoir 6 into ring volume 5, e.g. through tube 7. This inflates ring volume 5, causing it to seal ring volume against ear canal 3 (step 120 in FIG. 3). As with other embodiments, compressible gas volume 8 acts as a spring and prevents against creating excessive pressure where ring volume 5 contacts ear canal 3 (step 110 in FIG. 3).

Alternatively, door 9 may be opened and closed while hearing aid 10 is situated in ear canal 3 to more comfortably fit hearing aid 10 within ear canal 3 without having to remove and/or reposition hearing aid 10 within ear canal 3.

What is claimed is:

1. A cushioning device for use with a hearing aid instrument for positioning in the ear canal of a user, the hearing aid instrument comprising electronics, comprising:

a hearing aid housing, the housing configured to generally conform to the shape of the ear canal and containing the electronics of the hearing aid instrument;

a ring volume for encircling a predetermined portion of the hearing aid housing to separate the hearing aid housing from a portion of an ear canal of a user, the ring volume encompassing a pliant substance; and a reservoir of the pliant substance in fluid communication with the ring volume in a manner permitting bi-directional flow of the pliant substance between the reservoir and the ring volume, where the reservoir is disposed at least partially within the housing; and selectably engaged against a door movably disposed at an end of the hearing aid instrument opposite the ring volume, the door having a first closed position and a second open position, the closed position of the door creating an increase in pressure of the pliant substance within the reservoir and the open position of the door allowing a decrease in pressure of the pliant substance within the reservoir.

2. A cushioning device according to claim 1, wherein the ring volume is substantially torus-shaped.

3. A cushioning device according to claim 1, wherein the ring volume comprises flexible material permitting distortion of the ring volume in response to external pressure.

4. A cushioning device according to claim 1, further including a passageway coupling the reservoir and the ring volume to permit the bi-directional flow of the pliant substance between the reservoir and the ring volume.

5. A cushioning device according to claim 1, wherein the reservoir comprises a compressible gas volume supporting the bi-directional flow of the pliant substance in response to external pressure being applied to the ring volume.

6. A cushioning device according to claim 5, wherein the compressible gas volume comprises at least one of air, an inert gas, and a fluid other than the pliant material.

7. A cushioning device according to claim 1, wherein the reservoir housing material is flexible permitting distortion of the reservoir in response to external pressure.

8. A cushioning device according to claim 1, wherein the pliant substance comprises at least one of a fluid, an inert gas, a liquid, a gel, and a malleable substance.

9. A cushioning device according to claim 8, wherein the gel is a silicone gel.

10. A cushioning device according to claim 1, wherein the reservoir is affixed to the outer surface of the housing.

11. A cushioning device according to claim 1, wherein the door further comprises at least one of a battery and a battery holder adapted to hold the battery.

12. A method of cushioning a hearing aid instrument within an ear canal, the hearing aid instrument comprising electronics;

a hearing aid housing, the housing configured to generally conform to the shape of the ear canal and containing the electronics of the hearing aid instrument;

a ring volume encircling a predetermined portion of the hearing aid housing to separate the housing from a portion of an ear canal of a user, the ring volume encompassing a pliant substance; and a reservoir of the pliant substance in fluid communication with the ring volume in a manner permitting bi-directional flow of the pliant substance between the reservoir and the ring volume;

the method comprising:

displacing a pliant substance from the ring volume to the reservoir, where displacing the pliant substance comprises opening a door in a housing of the hearing aid instrument, the door in communication with the reservoir, the reservoir at least partially disposed within the housing; and permitting the pliant substance to flow into the reservoir from the ring volume;

compressing a compressible gas volume disposed within the pliant substance; and adjusting the shape of the ring volume to a contour of an inner portion of the ear canal in conjunction with the displacement, where adjusting a shape of the ring volume comprises closing the door; and permitting the pliant substance to flow into the ring volume from the reservoir.

13. A method according to claim 12 wherein the step of displacing the pliant substance further comprises displacing the pliant substance in response to insertion of the hearing aid instrument into the ear canal.

14. A method according to claim 12, wherein displacing the pliant substance from the ring volume into the reservoir occurs before insertion of the hearing aid instrument into the ear canal.

15. A method according to claim 12, wherein:

opening the door creates a decrease in pressure of the pliant substance within at least one of the reservoir and the ring volume; and closing the door creates an increase in pressure of the pliant substance within at least one of the reservoir and the ring volume.

16. A hearing aid instrument for positioning in the ear canal of a user, comprising:

electronics;

a hearing aid housing, the housing configured to generally conform to the shape of the ear canal and containing the electronics of the hearing aid instrument;

a ring volume encircling a predetermined portion of the hearing aid housing to separate the housing from a portion of an ear canal of a user, the ring volume encompassing a pliant substance; and a reservoir of the pliant substance in fluid communication with the ring volume in a manner permitting bi-directional flow of the pliant substance between the reservoir and the ring volume, where the reservoir is disposed at least partially within the housing; and selectably engaged against a door movably disposed at an end of the hearing aid instrument opposite the ring volume, the door having a first closed position and a second open position, the closed position of the door creating an increase in pressure of the pliant substance within the reservoir and the open position of the door allowing a decrease in pressure of the pliant substance within the reservoir.

17. A hearing aid instrument according to claim 16, wherein the ring volume is substantially torus-shaped.

18. A hearing aid instrument according to claim 16, wherein the ring volume comprises flexible material permitting distortion of the ring volume in response to external pressure.

19. A hearing aid instrument according to claim 16, further including a passageway coupling the reservoir and the ring volume to permit the bi-directional flow of the pliant substance between the reservoir and the ring volume.

20. A hearing aid instrument according to claim 16, wherein the reservoir comprises a compressible gas volume supporting the bi-directional flow of the pliant substance in response to external pressure being applied to the ring volume.

21. A hearing aid instrument according to claim 20, wherein the compressible gas volume comprises at least one of air, an inert gas, and a fluid other than the pliant material.

22. A hearing aid instrument according to claim 16, wherein the reservoir housing material is flexible permitting distortion of the reservoir in response to external pressure.

23. A hearing aid instrument according to claim 16, wherein the pliant substance comprises at least one of a fluid, an inert gas, a liquid, a gel, and a malleable substance.

24. A hearing aid instrument according to claim 23, wherein the gel is a silicone gel.

25. A hearing aid instrument according to claim 16, wherein the reservoir is affixed to the outer surface of the housing.

26. A hearing aid instrument according to claim 16, wherein the door further comprises at least one of a battery and a battery holder adapted to hold the battery.

* * * * *